US011590429B2

(12) United States Patent
Lovik et al.

(10) Patent No.: US 11,590,429 B2
(45) Date of Patent: Feb. 28, 2023

(54) REMOVABLE DEVICE FOR CONTROL OF A HAND PUPPET

(71) Applicant: Craig John Lovik, Friday Harbor, WA (US)

(72) Inventors: Craig John Lovik, Friday Harbor, WA (US); Matthew Daniel Campbell, Arlington, WA (US)

( * ) Notice: Subject to any disclaimer, the term of this patent is extended or adjusted under 35 U.S.C. 154(b) by 0 days.

(21) Appl. No.: 17/073,846

(22) Filed: Oct. 19, 2020

(65) Prior Publication Data

US 2022/0118371 A1 Apr. 21, 2022

(51) Int. Cl.
*A63H 3/14* (2006.01)
*A63H 3/20* (2006.01)

(52) U.S. Cl.
CPC ..... *A63H 3/14* (2013.01); *A63H 3/20* (2013.01)

(58) Field of Classification Search
CPC ..... A63H 3/14; A63H 3/20
USPC ..... 446/327, 329, 330, 337, 338, 339
See application file for complete search history.

(56) References Cited

U.S. PATENT DOCUMENTS 569,475 A * 10/1896 Roescher ..... A63H 3/40 446/337
1,886,442 A * 11/1932 Wimmer ..... A63H 13/02 446/338
2,633,670 A * 4/1953 Steuber ..... A63H 3/14 446/329
2,801,495 A * 8/1957 Enison ..... A63H 3/14 446/329
3,153,871 A * 10/1964 Semba ..... A63H 13/02 446/337
3,195,269 A * 7/1965 Weih ..... A63H 3/48 446/340
3,210,887 A * 10/1965 Glass ..... A63H 3/48 446/190
4,244,138 A * 1/1981 Holahan ..... A63H 13/02 446/365
4,244,139 A * 1/1981 Erickson ..... A63H 3/20 446/304
4,695,265 A * 9/1987 Clark ..... A63H 3/18 446/329
5,145,445 A * 9/1992 Northey ..... A63H 3/14 446/329
6,431,941 B1 * 8/2002 Frawley ..... A63H 3/20 446/337
8,795,026 B2 * 8/2014 Geppert ..... A63H 13/005 446/329
9,636,593 B1 * 5/2017 Dexter ..... A63H 3/00
2004/0077275 A1 * 4/2004 Burbank ..... A63H 3/14 446/321
2006/0183402 A1 * 8/2006 von Jabba ..... A63H 3/20 446/359

(Continued)

*Primary Examiner* — Joseph B Baldori
(74) *Attorney, Agent, or Firm* — FIG. 1 Patents

(57) ABSTRACT

A removable device for control of a hand puppet is described. A hand puppet includes a head having a superior cavity and an inferior cavity that corresponds to the jaw of the hand puppet. A first appendage of the removable device is configured to be inserted into the superior cavity, and a second appendage of the removable device is configured to be inserted into the inferior cavity. Further, a control of the removable device is configured to control rotation of the second appendage such that the second appendage causes the hand puppet's mouth to open and close by moving the jaw.

13 Claims, 12 Drawing Sheets

(56) References Cited

U.S. PATENT DOCUMENTS

2007/0184751 A1* 8/2007 Kawata ..... A63H 3/14
446/327

* cited by examiner

Y
X
Z
Coordinate Axes 316
300
106
312
302
102
108
306a
112a
306
308
306b
304
110
112b
310
112
Axis 314

REMOVABLE DEVICE FOR CONTROL OF A HAND PUPPET

BACKGROUND

A hand puppet is a figure that a person (i.e., a puppeteer) can manipulate to open and close the hand puppet's mouth, such as to create the illusion that the hand puppet is talking, laughing, and/or making mouth-based expressions. For example, a puppeteer using a hand puppet may insert his or her arm into a body of the hand puppet, place his or her thumb in an inferior cavity of the hand puppet's head (i.e., the jaw), and place his or her fingers in a superior cavity of the hand puppet's head (i.e., against a "roof" of the hand puppet's mouth). By moving his or her fingers away from the thumb and moving the fingers back toward the thumb, the puppeteer opens and closes the hand puppet's mouth. Oftentimes, a puppeteer operates a hand puppet from behind a stage, so the puppeteer is hidden from an audience.

A puppet enthusiast may, after purchasing and using a hand puppet, wish to try ventriloquism. Ventriloquism involves a person (i.e., a ventriloquist) having a conversation with a ventriloquist figure while manipulating a multitude of controls used in connection with creating various facial expressions of the ventriloquist figure. Due to the "conversation" as well as the manner in which a ventriloquist figure is controlled, the ventriloquist figure typically sits on the ventriloquist's knee, lap, or a nearby chair while the ventriloquist, in full view of the audience, manipulates controls disposed on a stick or lever. Traditionally, when a trained ventriloquist operates a ventriloquist figure, its movements and expressions are generally more lifelike than those of a hand puppet.

Although many amateur puppet enthusiasts wish to try ventriloquism, the barrier to entry is generally higher than hand puppetry and the learning curve is steeper. This is at least partially because conventional ventriloquist figures are generally more expensive than conventional hand puppets and also because learning how to manipulate controls of a conventional ventriloquist figure can be time consuming. Moreover, there are drawbacks to operating a hand puppet as a ventriloquist figure. For example, conventional operation of a hand puppet requires the puppeteer's arm to be at least partially inserted into a body of the puppet. As such, operating the hand puppet on the puppeteer's knee, lap, or a nearby chair in connection with ventriloquism thus forces the puppeteer into a position that can be awkward and uncomfortable. Due to such drawbacks, a number of puppet enthusiasts that ultimately transition from traditional hand puppet use to instead using hand puppets for ventriloquism as well as a number of puppet enthusiasts that simply try using hand puppets for ventriloquism may be limited.

SUMMARY

To overcome these problems, a removable device is used to control a hand puppet. A hand puppet includes a head having a superior cavity and an inferior cavity that corresponds to the jaw of the hand puppet. A first appendage of the removable device is configured to be inserted into the superior cavity, and a second appendage of the removable device is configured to be inserted into the inferior cavity. Further, a control of the removable device is configured to control rotation of the second appendage such that the second appendage causes the hand puppet's mouth to open and close by moving the jaw. As the second appendage opens and closes, the first appendage is configured to remain substantially stationary, such that the first appendage causes a top portion of the hand puppet's head also to remain substantially stationary. The removable device is further configured to be removed from the hand puppet and inserted into an additional hand puppet. Therefore, the removable device is capable of operating a plurality of hand puppets.

This Summary introduces a selection of concepts in a simplified form that are further described below in the Detailed Description. As such, this Summary is not intended to identify essential features of the claimed subject matter, nor is it intended to be used as an aid in determining the scope of the claimed subject matter.

BRIEF DESCRIPTION OF THE DRAWINGS

The detailed description is described with reference to the accompanying figures.

DETAILED DESCRIPTION

Overview

Figure 1:
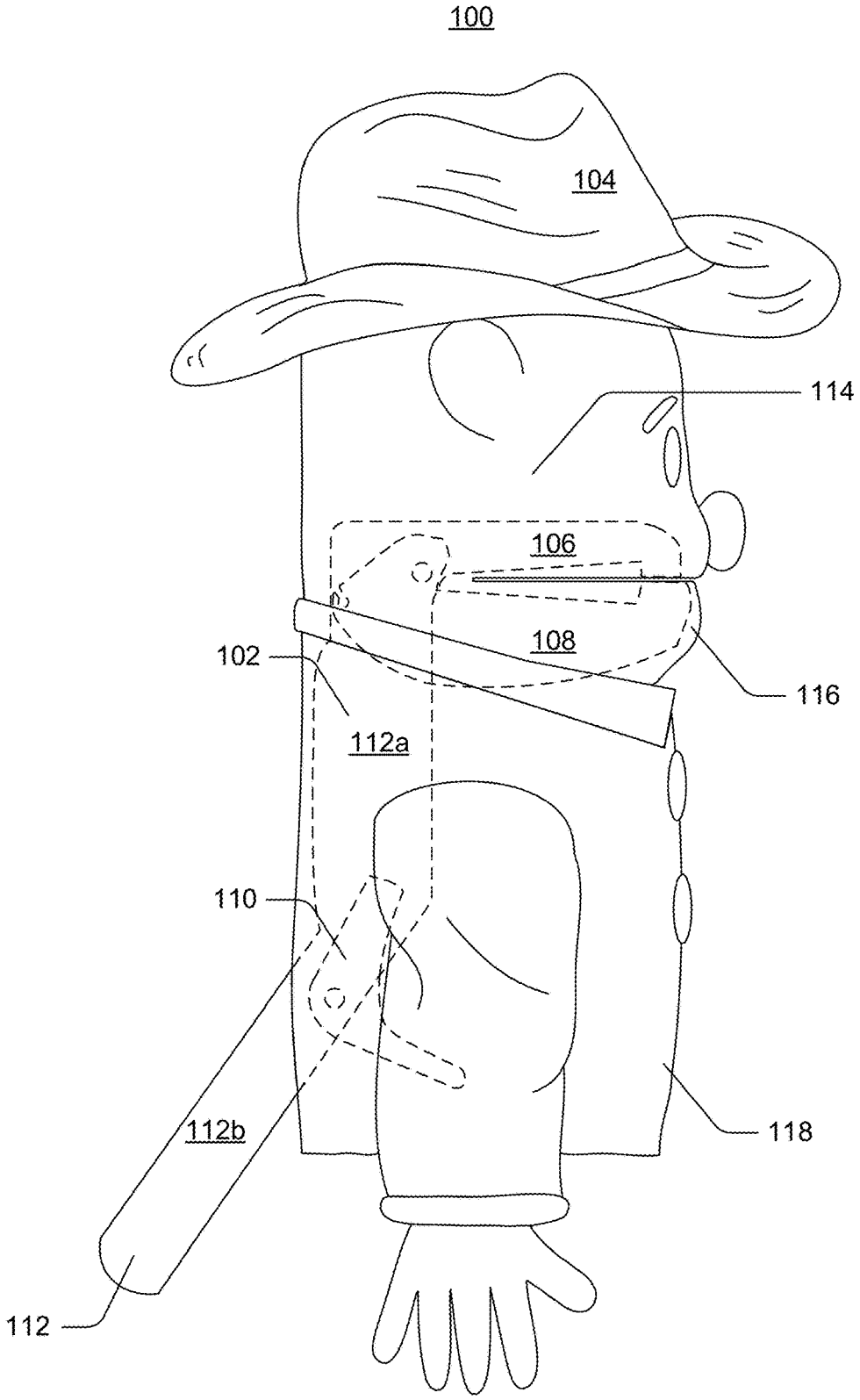
FIG. 1 is an illustration of a hand puppet with a removable device for control of the hand puppet.

As an activity, ventriloquism may have a higher barrier to entry than other activities and, notably, a higher barrier to entry than using hand puppets. This is in part because conventional ventriloquist figures are generally more expensive than conventional hand puppets and also because learning how to manipulate controls of conventional ventriloquist figures is time-consuming. Further, there are drawbacks to operating a hand puppet as a ventriloquist figure using conventional approaches to hand puppet operation. By way of example, conventional operation of a hand puppet requires a puppeteer's arm to be at least partially inserted into a body of the hand puppet. Due to this, operating the hand puppet on the puppeteer's knee, lap, or a nearby chair may force the puppeteer into a position that can be awkward and uncomfortable. Furthermore, conventional operation of a hand puppet generally causes an entire top portion of the hand puppet's head to swing open in relation to the jaw, resulting in an unrealistic mouth movement of the hand puppet. These drawbacks may limit the number of people that use hand puppets for ventriloquism, which may limit the number of ventriloquists overall.

A removable device for control of a hand puppet is described herein. In accordance with the described techniques, the removable device can be inserted into a hand puppet to control mouth movement of the hand puppet. In one or more implementations, the removable device may include a first appendage and a second appendage. In general, the first appendage may be inserted into a superior cavity of the hand puppet's head, where the superior cavity corresponds to a top portion of the head. This may include, for example, the roof of the hand puppet's mouth and features of the hand puppet that are generally disposed superior to the roof of the mouth. In contrast, the second appendage may be inserted into an inferior cavity of the hand puppet's head, where the inferior cavity corresponds to a jaw of the hand puppet.

The removable device further includes a control configured to control rotation of the second appendage. Since the second appendage is inserted into the inferior cavity, this rotation causes the jaw of the hand puppet to open and close in relation to the roof of the hand puppet's mouth. For example, force may be applied to the control via a hand of a puppeteer to cause the jaw of the hand puppet to open in relation to the roof of the hand puppet's mouth. Additionally, force may be released from the control via the hand of the puppeteer to cause the jaw of the hand puppet to close in relation to the roof of the hand puppet's mouth. During the opening and closing of the hand puppet's jaw, the first appendage is configured to remain substantially stationary. Due to this, the first appendage also maintains the top portion of the hand puppet's head in a substantially stationary position, as the jaw of the hand puppet opens and closes. This results in more realistic movement of the hand puppet's mouth because it emulates the manner in which humans and other creatures move their mouths. Moreover, this movement of the jaw to open and close while the top of the hand puppet's head remains substantially stationary contrasts with conventional operation of hand puppets "by hand," which typically causes the top of the hand puppet's head to swing backward.

In addition, the control may be disposed on a handle of the removable device. As discussed in more detail below, the removable device may be configured such that a length of the handle separates the control from the first and second appendages, e.g., by a distance that allows a puppeteer to operate a puppet without reaching his or her hand all the way to the puppet's mouth. Rather, the puppeteer may manipulate the control to cause the mouth of the hand puppet to open and close, while the puppeteer's hand is separated from the mouth of the hand puppet by the distance. Due to this separation, the puppeteer may operate the hand puppet comfortably while the hand puppet is on his or her lap, knee, or a nearby chair.

The removable device is also configured to be removed from the hand puppet without damaging the hand puppet or altering standalone (e.g., "by hand") operation of the hand puppet. In other words, after the removable device is removed from the hand puppet, the hand puppet is still capable of being operated by hand in the conventional manner. The removable device is further configured to be inserted into an additional hand puppet. In this way, the removable device can be used to operate multiple, different hand puppets, e.g., by removing the removable device from a hand puppet and inserting it into a different hand puppet.

In the following discussion, an example removable device is described by way of example as being operated based on manipulation of a control by a person's hand. However, it should be readily apparent that the following discussion is not limited to manipulation of the control by a person's hand. The removable device may be manipulated in other ways to control mouth movement of a hand puppet without departing from the spirit or scope of the described techniques.

Example Removable Device

FIG. 1 is an illustration of an example implementation 100 of a hand puppet with a removable device for control of the hand puppet. The illustrated example 100 includes a removable device 102 and a hand puppet 104. The removable device 102 includes a first appendage 106, a second appendage 108, a control 110. The removable device 102 further includes a handle 112 comprised of a superior portion of the handle 112*a* and an inferior portion of the handle 112*b*. The hand puppet 104 includes a superior cavity 114 disposed within a head of the hand puppet 104, an inferior cavity 116 also disposed within the head of the hand puppet 104 but inferior to the superior cavity 114, and a body 118 that is disposed substantially inferior to the head of the hand puppet 104.

Figure 2:
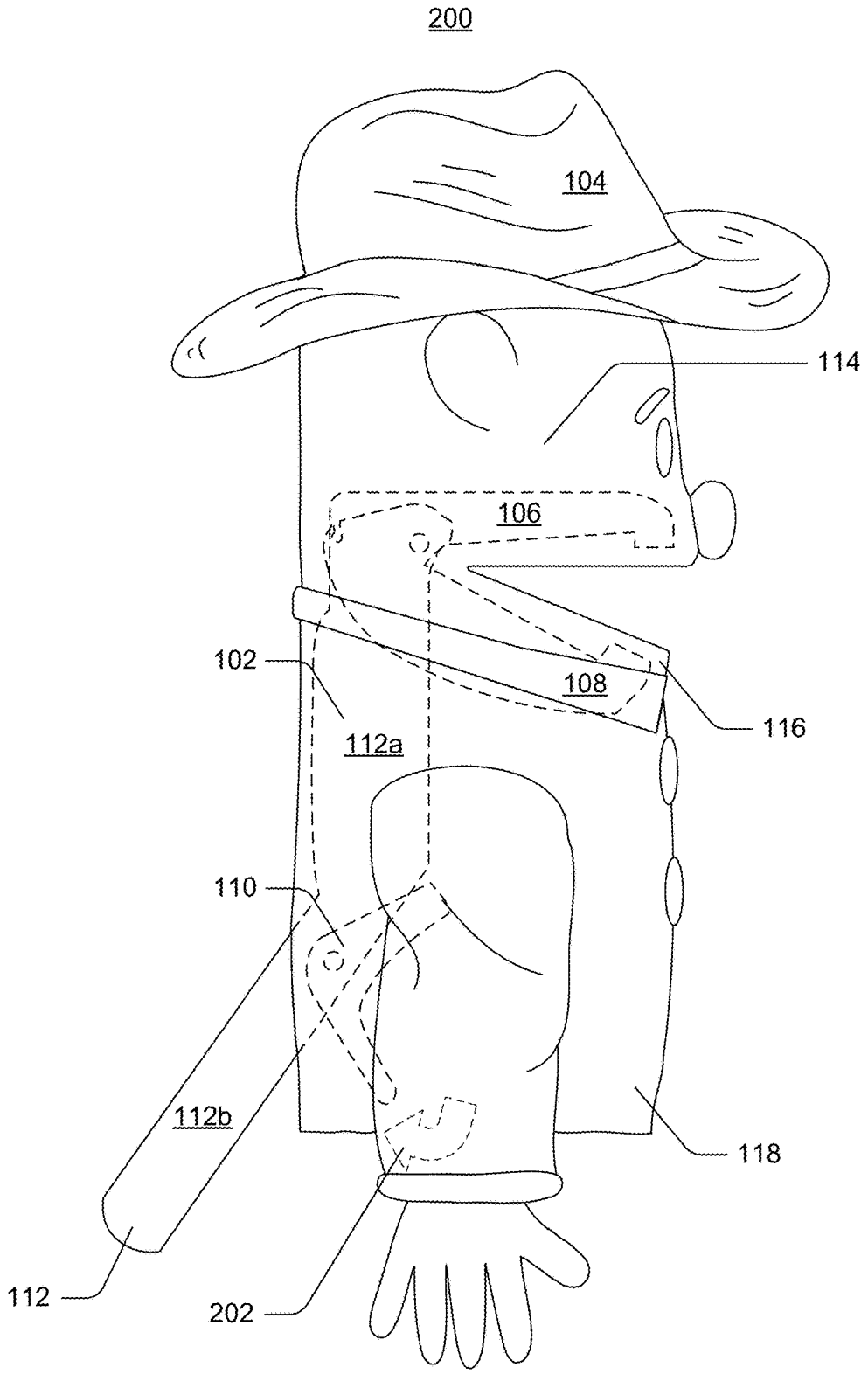
FIG. 2 depicts the removable device being manipulated to cause a mouth of the hand puppet to open.

FIG. 2 depicts an example implementation 200 of the removable device being manipulated to cause a mouth of the hand puppet to open. The illustrated example includes an application of force 202 applied to the control 110 to cause the mouth of the hand puppet 104 to open.

The first appendage 106 of the removable device 102 is configured to be inserted into the superior cavity 114. The superior cavity 114 corresponds to a portion of the hand puppet 104's head which includes a roof of the hand puppet 104's mouth and features of the hand puppet 104 that are generally disposed superior to the roof of the mouth, such as nose, eyes, eyebrows, hair, hat, and so on. In one or more implementations, the first appendage 106 is configured to remain substantially stationary in relation to the handle 112 during operation of the removable device 102. In this way, the first appendage 106 causes the top portion of the head, which corresponds to the superior cavity 114, to remain substantially stationary during operation of the removable device 102.

In contrast, the second appendage 108 is configured to be inserted into the inferior cavity 116. The inferior cavity 116 corresponds to a jaw the hand puppet 104. The second appendage 108 is configured to rotate from a closed position, as shown in FIG. 1, to an open position, as shown in FIG. 2. Thus, during operation, the first appendage 106 is configured to remain substantially stationary relative to the handle 112 while the second appendage 108 is configured to open and close. Rotation of the second appendage 108 from the closed position to the open position is configured to cause an application of force against an inferior interior surface of the hand puppet 104's jaw, e.g., that houses the inferior cavity 116. This application of force causes a position of the inferior cavity 116 to move in relation to the superior cavity 114, causing the jaw of the hand puppet 104 to open in relation to the roof of the mouth and creating an open mouth expression of the hand puppet 104. Further, rotation of the second appendage 108 from the open position to the closed position is configured to cause application of force against a superior interior surface of the hand puppet 104's jaw, e.g., that houses the inferior cavity 116. This application of force causes a position of the inferior cavity 116 to move in relation to the superior cavity 114, causing the jaw of the hand puppet 104 to close in relation to the roof of the mouth and creating a closed mouth expression of the hand puppet 104. Therefore, the removable device 102 causes the jaw of the hand puppet 104 to move in relation to the roof of the hand puppet 104's mouth, while the roof of the hand puppet 104's mouth remains substantially stationary. This creates a realistic mouth movement of the hand puppet 104 that emulates mouth movement of a person or other creature.

The control 110 is configured to control rotation of the second appendage 108. For example, manipulation of the control 110 by a hand of a user causes the second appendage 108 to open and close the mouth of the hand puppet 104 by moving the jaw. As shown in FIG. 2, the application of force 202 applied to the control 110 causes the second appendage 108 to rotate to the depicted open position. The application of force 202 applied to the control 110, by causing the second appendage 108 to rotate to the open position, further causes the above-discussed force to be applied to the inferior interior surface of the hand puppet 104's jaw—creating the open mouth expression. Additionally, release of the application of force 202 from the control 110, by causing the second appendage 108 to return to the closed position, further causes the above-discussed force to be applied to the superior interior surface of the hand puppet 104's jaw—creating the closed mouth expression.

As illustrated, the control 110 is disposed on the handle 112 and the first appendage 106 and the second appendage 108 extend from the handle 112. As shown in FIGS. 1 and 2, the first appendage 106 and the second appendage 108 may extend from the superior portion of the handle 112*a*, and the control 110 may be disposed at the inferior portion of the handle 112*b* that is separated from the superior portion by a length.

In one or more implementations, the handle 112 is configured to extend outside the body 118 of the hand puppet 104 to facilitate user manipulation of the removable device 102 at least partially outside the body 118. For example, the inferior portion of the handle 112*b* may extend at least partially away, in a posterior direction, from the superior portion of the handle 112*a*. It follows then that the superior portion of the handle 112*a* may thus have a generally anterior position in relation to the inferior portion of the handle 112*b*, e.g., where anterior corresponds to a front or face of a hand puppet. In this way, the inferior portion of the handle 112*b* may form an obtuse angle with respect to the superior portion of the handle 112*a* as depicted. Due to this, the handle 112 may extend at least partially outside a posterior portion of the body 118 of the hand puppet 104, as shown in FIGS. 1 and 2. Thus, a user may manipulate the control 110 while the hand of the user is at least partially outside the body 118. The hand of the user may also be at least partially concealed by the body 118 of the hand puppet 104.

The handle 112 is also configured such that the control 110 is separated from the first and second appendages 106, 108 substantially by a length. This enables the hand of a user manipulating the control 110 to control mouth movement of the hand puppet 104 at a distance from the mouth of the hand puppet 104, rather than having the user's hand inserted into the hand puppet 104 and controlling movement of the mouth with fingers and thumb inserted into the superior and inferior cavities 114, 116, respectively. For example, the control 110 may be disposed at a predefined length below the second appendage 108 to facilitate user manipulation of the control 110 toward an inferior portion of the body 118. The predefined length may be generally different for different sized hand puppets. For example, the length between the control 110 and the first and second appendages 106, 108 may be greater for a removable device 102 built for 30-inch hand puppets than for a removable device 102 build for 25-inch hand puppets. In this way, a user may comfortably operate the hand puppet 104 using the removable device 102 while the hand puppet 104 is disposed on the user's lap, knee, or a nearby chair. Notably, this distance enables the user to operate the hand puppet 104 on his or her lap, knee, or nearby chair without reaching his or her arm into the hand puppet 104 and creating an awkward position in order to operate the hand puppet 104 on the lap, knee, or nearby chair.

The removable device 102 is additionally configured to be removed from the hand puppet 104 and inserted into an additional hand puppet. To this end, the removable device 102 is capable of controlling mouth movement of multiple hand puppets at different times. To do so, the removable device 102 may be inserted into the hand puppet 104, removed from the hand puppet 104, inserted into an additional hand puppet, removed from the additional hand puppet, and so forth. When inserted into the hand puppet 104 and removed from the hand puppet 104, the removable device 102 is configured not to damage or alter the hand puppet 104 or the removable device 102. A single removable device 102 is thus capable of operating a plurality of hand puppets.

Moreover, the removable device 102 is configured to be inserted into the hand puppet 104 and removed from the hand puppet 104 without altering standalone operation of the hand puppet 104 when the removable device 102 is removed. As used herein, the term "standalone" operation or operation "by hand" refers to conventional operation of the hand puppet 104 where a user's hand is inserted into the hand puppet 104, such that generally fingers are disposed in the superior cavity 114 and a thumb is disposed in the inferior cavity 116. This conventional operation involves moving the fingers and thumb away from and back toward one another to open and close the mouth, respectively. Thus, when the removable device 102 is removed from the hand puppet 104, the hand puppet 104 is capable of being operated in accordance with conventional hand puppet operation. For example, the removable device 102 may be removed from the hand puppet 104, and a user may still manipulate the mouth of the hand puppet 104 by hand, e.g., using fingers and thumb. Therefore, the hand puppet 104 is capable of being operated in a manner that is similar to ventriloquism when the removable device 102 is inserted into the hand puppet 104. Then, by simply removing the removable device 102 from the hand puppet 104, the hand puppet 104 may be operated as a conventional hand puppet in a matter of seconds.

Figure 3:
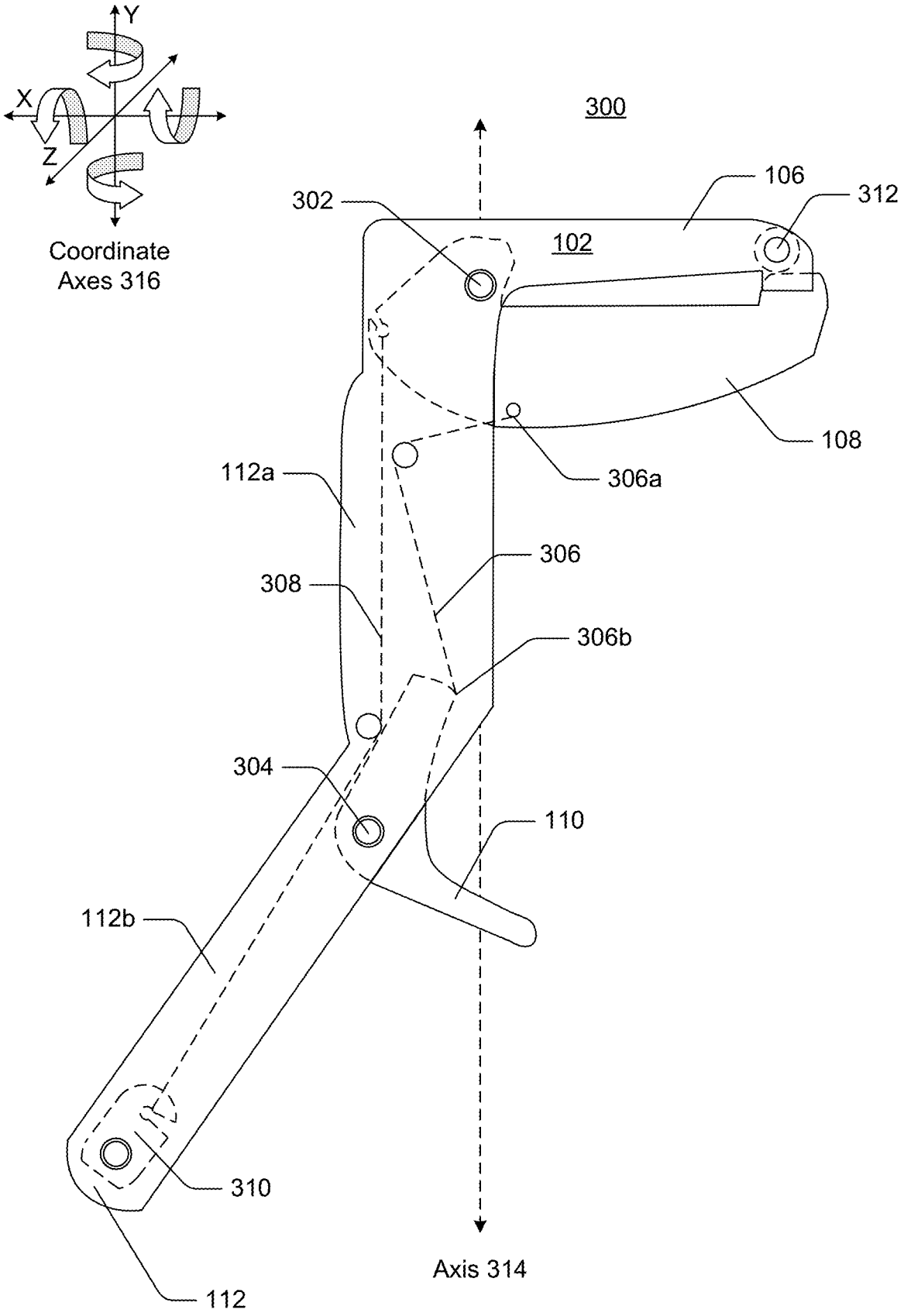
FIG. 3 depicts the removable device in greater detail.

FIG. 3 depicts an example 300 of the removable device from FIGS. 1 and 2 in greater detail. In this example 300, the removable device 102 includes a first hinge element 302 about which the second appendage 108 rotates and a second hinge element 304 about which the control 110 rotates. The removable device 102 is also depicted including a flexible connector 306 attached to the second appendage 108 at a first attachment point 306*a* and attached to the control 110 at a second attachment point 306*b*. The removable device 102 is further depicted including a tensioner 308 attached to the second appendage 108 and an anchor 310. The illustrated example 300 also depicts a barrier 312.

Figure 4:
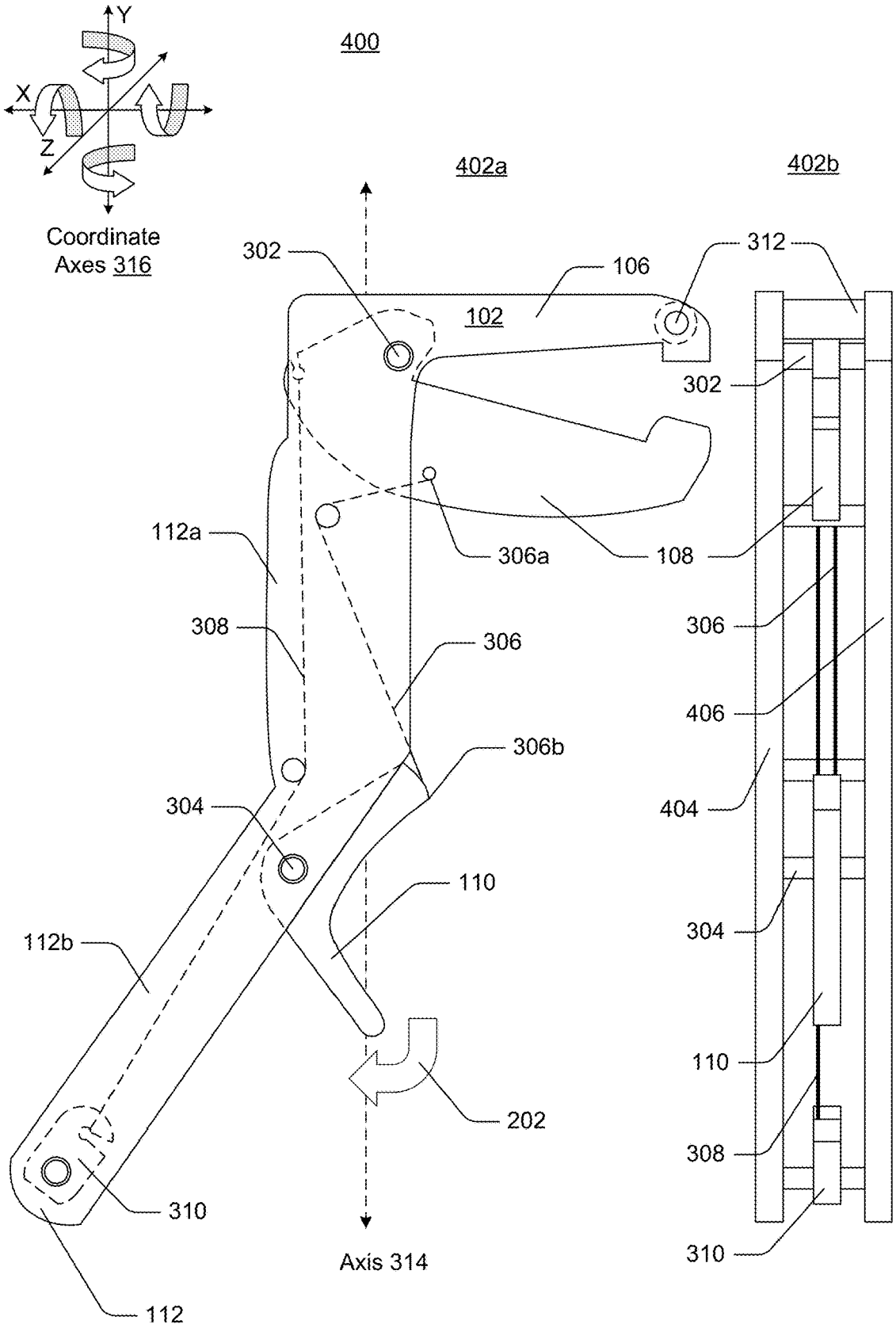
FIG. 4 depicts the removable device in greater detail and as manipulated to cause an appendage of the removable device to open.

FIG. 4 depicts an example 400 of the removable device from FIGS. 1 and 2 in greater detail and as manipulated to cause an appendage of the removable device to open. In this example 400, the removable device 102 is depicted in a side view 402*a* as well as a front view 402*b*. The front view 402*b* depicts the handle 112 and the first appendage 106 as formed from a first handle-appendage portion 404 and a second handle-appendage portion 406.

In one or more implementations, the handle 112 and the first appendage 106 are formed from the first handle-appendage portion 404 and the second handle-appendage portion 406. The two handle-appendage portions 404, 406 may be connected with multiple spacers, which also separate the two handle-appendage portions 404, 406 by distance that is suitable for the second appendage 108 to be disposed between the first and second handle-appendage portions 404, 406. This connection of the first and second handle-appendage portions 404, 406 with the spacers, which separates them by the distance is effective to create a space between the first and second handle-appendage portions 404, 406. In this space between the two handle-appendage portions 404, 406, the second appendage 108, the control 110, the first hinge element 302, the second hinge element 304, the flexible connector 306, the tensioner 308, the anchor 310, and the barrier 312 are disposed. In other words, the first appendage 106 and the handle 112 comprise an outer portion of the removable device 102, while the other elements of the removable device 102 are at least partially housed between the handle-appendage portions 404, 406, which, as noted above, form the first appendage 106 and the handle 112 of the removable device 102. To the extent that the other elements of the removable device 102 may be housed at least partially between two handle-appendage portions 404, 406, they are illustrated at least partially by dashed lines in FIGS. 3 and 4. Although the handle 112 and the first appendage 106 may be formed by connecting the two handle-appendage portions 404, 406, as discussed above, it is to be appreciated that the handle 112 and the first appendage 106 may be formed in other ways without departing from the spirit or scope of the described techniques. By way of example, the handle 112 and the first appendage 106 may be formed using a single handle-appendage portion, such that the second appendage 108, the control 110, and so forth, are simply disposed on a face of the single handle-appendage portion.

In the illustrated examples 300, 400, the superior portion of the handle 112*a* is disposed substantially along an axis 314, which extends substantially longitudinally through the superior portion of the handle 112*a*. As illustrated, the first appendage 106 extends from the superior portion of the handle 112*a* substantially perpendicular to the axis 314. The first appendage 106 may extend continuously from the handle 112, such that each of the handle-appendage portions 404, 406 forming the first appendage 106 and the handle 112 are a single piece of material. It is to be appreciated that the first appendage 106 and the handle 112 may be separate pieces of material, such that the first appendage 106 is attached or otherwise fastened to the handle 112 or such that a first appendage sub-portion of one of the handle-appendage portions 404, 406 is attached or otherwise fastened to a handle sub-portion of the one of the handle-appendage portions 404, 406.

As noted above, the removable device 102 includes the barrier 312. The barrier 312 may be disposed between the two handle-appendage portions 404, 406. Moreover, the barrier 312 may be disposed within or on the first appendage 106, such that the barrier 312 is configured as a blockade that arrests closing movement of the second appendage 108 so that the second appendage 108 remains in a fixed (e.g., closed) position when force is released from or not applied to the control 110 by a user. In other words, when no force is applied to the control 110 by a user, the second appendage 108 may contact the barrier 312, which prevents the second appendage 108 from rotating past the default, closed position. For example, responsive to release of a force applied to the control 110, the second appendage 108 is configured (e.g., biased with the tensioner 308) to rotate in a sagittal plane—counter clockwise in the side view of the illustrated example 400—until the barrier 312 prevents the second appendage 108 from rotating any further. In this way, when no force is applied to the control 110, the second appendage 108 may rest in a default position. Additionally, this default position of the second appendage 108 illustrated in FIG. 3 may correspond to the closed-mouth expression of the hand puppet 104, as shown in FIG. 1, when the removable device 102 is inserted into the hand puppet 104.

The second appendage 108 also extends from the superior portion of the handle 112*a*. In the default position, the second appendage 108 may be disposed substantially perpendicular to the axis 314. However, in response to an application of the force 202 applied to the control 110, the second appendage 108 is configured to rotate about the first hinge element 302.

In the following discussion, consider the movement of the second appendage 108 in relation to a first coordinate axes 316, such that an origin of the first coordinate axes 316 is centered at a center of the first hinge element 302 and such that a y-axis of the first coordinate axes 316 is parallel to or corresponds to the axis 314. Here, the x-axis and the y-axis may define a sagittal plane in relation to the removable device 102. The z-axis of the first coordinate axes 316 is perpendicular to this plane, and the first hinge element 302 may be disposed such that when an origin of the first coordinate axes 316 is centered at a center and mid-length of the first hinge element 302, the z-axis extends substantially through a length of the first hinge element 302, i.e., the z-axis corresponds to a central axis of the first hinge element 302.

Given this, the second appendage 108 is configured to rotate substantially around the z-axis of the first coordinate axes 316—a movement in the sagittal plane. As previously discussed, the rotation of the second appendage 108 causes the jaw of the hand puppet 104 to rotate when the removable device 102 is inserted into the hand puppet 104, as shown in FIGS. 1 and 2. Due to this, the second appendage 108 causes the mouth of the hand puppet 104 to also rotate substantially around the z-axis of the first coordinate axes 316—a movement in the sagittal plane.

For instance, in response to the application of force 202, the second appendage 108 is configured to rotate about the first hinge element 302 (with respect to the view of the removable device 102 depicted in FIG. 3 and the side view 402*a*) in a clockwise direction—from a closed position, as shown in FIG. 3, to an open position, as shown in FIG. 4. For the ease of discussion, the terms "clockwise" and "counter-clockwise" refer to the direction of rotation as depicted in these noted views, e.g., the view of FIG. 3 and the side view 402*a*. Notably, the direction of rotation may be in the opposite direction depending on the viewpoint from which the removable device 102 is perceived.

The first hinge element 302 may be configured as a cylindrical rod attached or fastened to the two handle-appendage portions 404, 406, and the second appendage 108 may include a hole. In this way, this cylindrical rod may be disposed such that it extends through the hole in the second appendage 108 to facilitate rotation of the second appendage 108 about the first hinge element 302, as illustrated. It is to be appreciated that the first hinge element 302 may be disposed in a variety of positions in relation to the handle 112 and the first appendage 106. By way of example and not limitation, the first hinge element 302 may be disposed between the two handle-appendage portions 404, 406 within the first appendage 106, within the superior portion of the handle 112*a*, or partially within the first appendage 106 and partially within the superior portion of the handle 112*a*, to name just a few.

The control 110 may be disposed between the two handle-appendage portions 404, 406 within the inferior portion of the handle 112*b* and is configured to rotate about the second hinge element 304. In the following discussion, consider the movement of the control 110 in relation to a second coordinate axes 316, such that an origin of the second coordinate axes 316 is centered at a center of the second hinge element 304 and such that a y-axis of the second coordinate axes 316 is parallel to the axis 314. Here, the x-axis and the y-axis may define a sagittal plane in relation to the removable device 102. The z-axis of the second coordinate axes 316 is perpendicular to this plane, and the second hinge element 304 is configured such that when an origin of the second coordinate axes 316 is centered at a center and mid-length of the second hinge element 304, the z-axis extends substantially through a length of the second hinge element 304, i.e., the z-axis corresponds to a central axis of the second hinge element 304.

In accordance with the described techniques, the control 110 is configured to rotate substantially around the z-axis of the second coordinate axes 316—a movement in the sagittal plane. Given this, in response to the application of the depicted force 202, the control 110 is configured to rotate about the second hinge element 304 (with respect to the view of the removable device 102 depicted in FIG. 3 and the side view 402*a*) in the clockwise direction. With release of the force 202, the control 110 is configured to rotate about the second hinge element 304 in the opposite direction.

Similar to the first hinge element 302, the second hinge element 304 may be configured as a cylindrical rod connected or attached to the two handle-appendage portions 404, 406, and the control 110 may include a hole. In this way, this cylindrical rod may be disposed such that it extends through the hole in the control 110 to facilitate rotation of the control 110 about the second hinge element 304. It is to be appreciated that the control 110 and the second hinge element 304 may be disposed in a variety of positions in relation to the handle 112. By way of example and not limitation, the control 110 and the second hinge element 304 may be disposed between the two handle-appendage portions 404, 406 at various positions along the inferior portion of the handle 112*b*. For instance, the control 110 and the second hinge element 304 may be disposed inferior to the depicted position to facilitate user manipulation of the control 110 further from the mouth of the hand puppet 104 when the removable device 102 is inserted into the hand puppet 104.

In one or more implementations, the first and second hinge elements 302, 304 may each include a friction reducing element such as a bearing (e.g., ball bearing) to facilitate rotation of the second appendage 108, and rotation of the control 110 with reduced friction. For example, a ball bearing may be disposed between the rod of the first hinge element 302 and the hole in the second appendage 108. Although the two hinge elements 302, 304 are depicted having a rod-through-hole configuration, it is to be appreciated that the two hinge elements 302, 304 may be configured as different types of hinges without departing from the spirit or scope of the described techniques. By way of example, the first hinge element 302 may be configured as a butt hinge with a first leaf fastened to the first appendage 106 and a second leaf fastened to the second appendage 108 to facilitate rotation of the second appendage 108.

As previously discussed, the control 110 is configured to control rotation of the second appendage 108. To do so, the flexible connector 306 is configured to be attached to the second appendage 108 at the first attachment point 306*a* and to a superior portion of the control 110 at the second attachment point 306*b*. In this way, when the force 202 is applied to an inferior portion of the control 110 (e.g., a trigger), the control 110 is configured to rotate in the clockwise direction to create tension in the flexible connector 306. The tension in the flexible connector 306 may then cause force to be applied to the second appendage 108, via the first attachment of the flexible connector 306 to the second appendage 108. This force applied to the second appendage 108 pulls on the second appendage 108 at the first attachment point 306*a*. The first attachment point 306*a* is configured to be disposed on the second appendage 108 at a radial distance from the first hinge element 302. In this way, the force applied to the second appendage 108 via the tension in the flexible connector 306 is at least partially tangential with respect to the first hinge element 302, i.e., the second appendage 108's rotation point. This tangential force creates torque in the second appendage 108 and causes the second appendage 108 to rotate clockwise about the first hinge element 302, from the closed position, as shown in FIG. 3, to the open position, as shown in FIG. 4.

Alternatively, the second appendage 108 and the control 110 are configured to be biased to return to the default position, as shown in FIG. 3, in response to a release of the application of force 202. To do so, the tensioner 308 may be made of an elastic material such that the tensioner 308 may constantly apply force via elastic tension to the second appendage 108. The tensioner 308 is configured to be attached to a posterior portion of the second appendage 108 and the anchor 310, as illustrated. In one or more implementations, the tensioner 308 may extend from its attachment to the second appendage 108 substantially parallel to the axis 314 within the superior portion of the handle 112*a*. Further, the elastic tension may apply force to the second appendage 108, via the attachment of the tensioner 308 to the second appendage 108. This force applied to the second appendage 108 pulls on the posterior portion of the second appendage 108 at a radial distance from the first hinge element 302. In this way, the force applied to the second appendage 108 via the elastic tension in the tensioner 308 is at least partially tangential with respect to the first hinge element 302, i.e., the second appendage 108's rotation point. This tangential force creates torque in the second appendage 108 and causes the second appendage 108 to rotate counterclockwise about the first hinge element 302, from the open position, as shown in FIG. 4, to the closed position, as shown in FIG. 3.

Although the tensioner 308 may be configured as an elastic tensioner, as discussed above, it is to be appreciated that the tensioner 308 may be configured in other ways without departing from the spirit or scope of the described techniques. By way of example, the tensioner 308 may be configured as a torsion spring, as discussed in more detail below in relation to FIG. 9.

As the tensioner 308 causes the second appendage 108 to rotate toward the default position, the flexible connector 306 is configured to allow the control 110 to rotate to the default position. For example, as the second appendage 108 rotates toward the default position in the counterclockwise direction, the flexible connector 306 applies force to the superior portion of the control 110 via the second attachment of the flexible connector 306 to the control 110. This force applied to the control 110 pulls on the superior portion of the control 110 at the second attachment point 306*b*. The second attachment point 306*b* is configured to be disposed on the control 110 at a radial distance from the second hinge element 304. In this way, the force applied to the control 110 via the flexible connector 306 due to the biasing of the tensioner 308 is at least partially tangential with respect to the second hinge element 304, i.e., the control 110's rotation point. This tangential force creates torque in the control 110 and causes the control 110 to rotate counterclockwise about the second hinge element 304. Given this, the control 110 may be returned to the default position, as shown in FIG. 3.

In one or more implementations, the flexible connector 306 and the tensioner 308 may wrap partially around one of the spacers that separate the two handle-appendage portions 404, 406, as shown. In this way, the flexible connector 306 and the tensioner 308 may be disposed substantially within the inner portion of the removable device 102 (e.g., within the two handle-appendage portions 404, 406). Additionally, the spacer around which the flexible connector 306 is partially wrapped allows the flexible connector 306 to pull on the second appendage 108 at a substantially tangential angle with respect to the first hinge element 302 (i.e., the second appendage 108's rotation point). Moreover, the spacer around which the tensioner 308 is partially wrapped allows the tensioner 308 to pull on the second appendage 108 at a substantially tangential angle with respect to the first hinge element 302 (i.e., the second appendage 108's rotation point).

In one or more implementations, the control 110 and the second appendage 108 are configured to rotate in the sagittal plane together. In other words, rotation of the second appendage 108 in the counterclockwise direction is configured to cause rotation of the control 110 in the counterclockwise direction. Similarly, rotation of the control 110 in the clockwise direction is configured to cause rotation of the second appendage 108 in the clockwise direction. This synchronized rotation may be caused by the attachment of the flexible connector 306 to both the second appendage 108 and the control 110 as well as the tensioner 308. For example, rotation of the second appendage 108 in the counterclockwise direction causes the flexible connector 306 to pull on the superior portion of the control 110, causing the control 110 to also rotate in the counterclockwise direction. Conversely, rotation of the control 110 in the clockwise direction causes the flexible connector 306 to pull on the second appendage 108, causing the second appendage 108 to also rotate in the clockwise direction.

As previously discussed, the barrier 312 is configured to prevent the second appendage 108 from rotating past the default, closed position. Since the second appendage 108 and the control 110 are configured to rotate together, the control 110 may similarly be configured to stop rotating as the second appendage 108 contacts the barrier 312. As a result, the second appendage 108 and the control 110 may be biased in respective default positions when no force is applied to the control 110.

Figure 5:
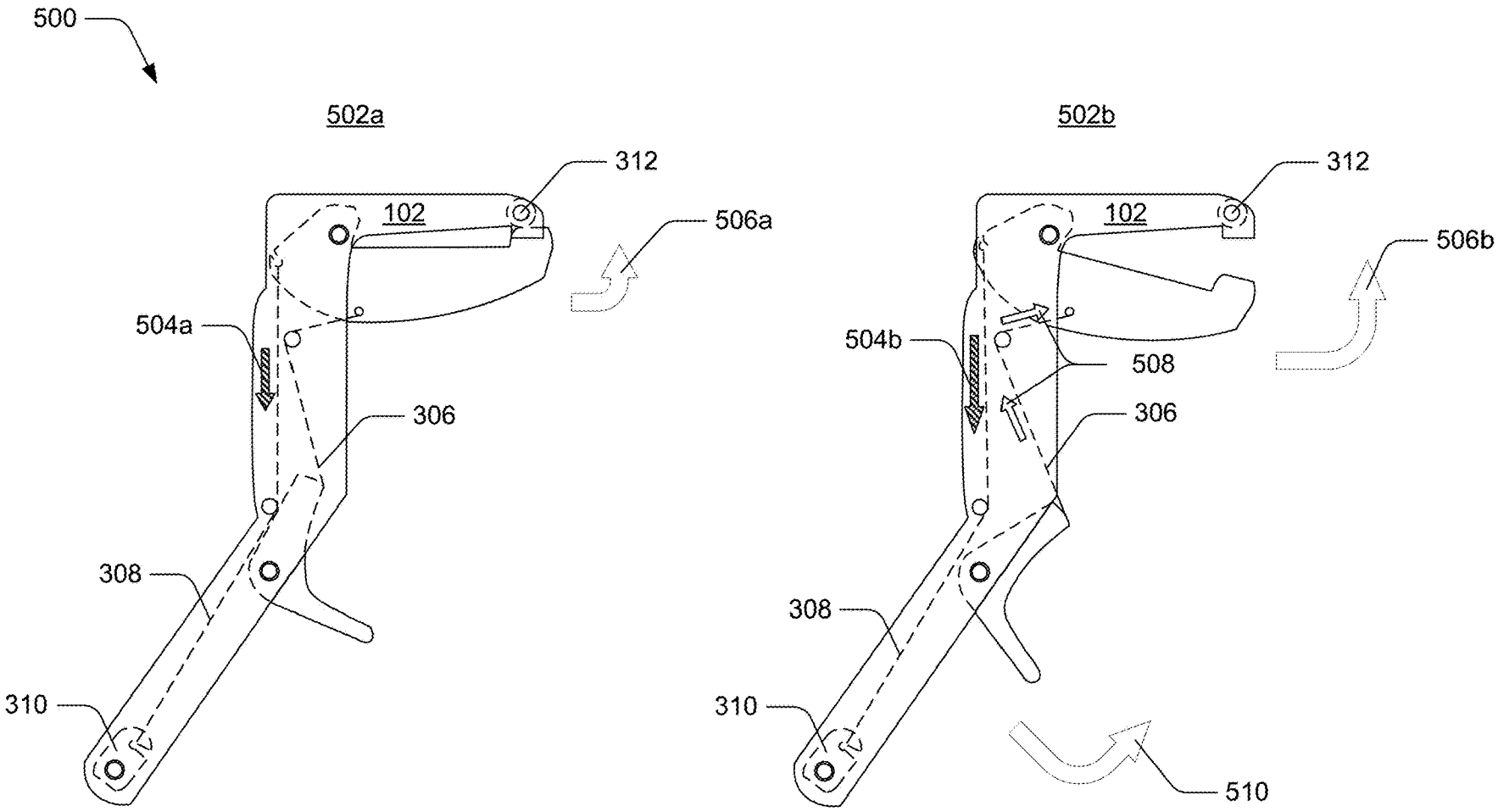
FIG. 5 depicts stages of operation in which forces are applied to various components of the removable device during operation of the removable device.

FIG. 5 depicts an example 500 of stages of operation in which forces are applied to various components of the removable device during operation of the removable device. Stage 502*a* depicts an example of the removable device 102 when no force is applied to the control 110 by a user, and stage 502*b* depicts the removable device 102 when the force 202 is applied to the control 110 by a user (not shown). FIG. 5 also includes various arrows which illustrate the forces applied to the components of the removable device 102 by the tensioner 308 throughout different stages of operation—both when no force is applied to the control 110 by a user and when force is applied to the control 110 by a user.

For example, the stage 502*a* depicts an elastic tension 504*a* applied to the second appendage 108 by the tensioner 308 when no force is applied to the control 110. As previously discussed, the elastic tension 504*a* creates a torque 506*a* in the second appendage 108. The torque 506*a* causes the second appendage 108 to rotate around the first hinge element 302 and contact the barrier 312, such that the second appendage 108 may rest in the default, closed position when no force is applied to the control 110.

In response to the force 202 being applied to the control 110, the second appendage 108 is configured to rotate from the default, closed position, as shown in the stage 502*a*, to the open position, as shown in the stage 502*b*. For instance, if the force 202 applied to the control 110 is greater than the elastic tension 504*a*, then the control 110 will rotate in the clockwise direction. This causes the second appendage 108 to rotate toward the open position, as previously discussed. In the open position, the posterior portion of the second appendage 108 may be positioned further from the anchor 310 than in the closed position, which causes an increase in an elastic tension 504*b*, as depicted by the increase in arrow size. As previously discussed, the elastic tension 504*b* creates a torque 506*b* in the second appendage 108. The torque 506*b* then creates a tension 508 in the flexible connector 306. The tension 508 may then pull on the superior portion of the control 110 to create a torque 510 in the control 110. In this way, once the force 202 is released, such that the force 202 applied to the control 110 is less than the elastic tension 504*b*, then the torque 506*b* may bias the second appendage 108 in the default position, and the torque 510 may bias the control 110 in the default position.

Figure 6:
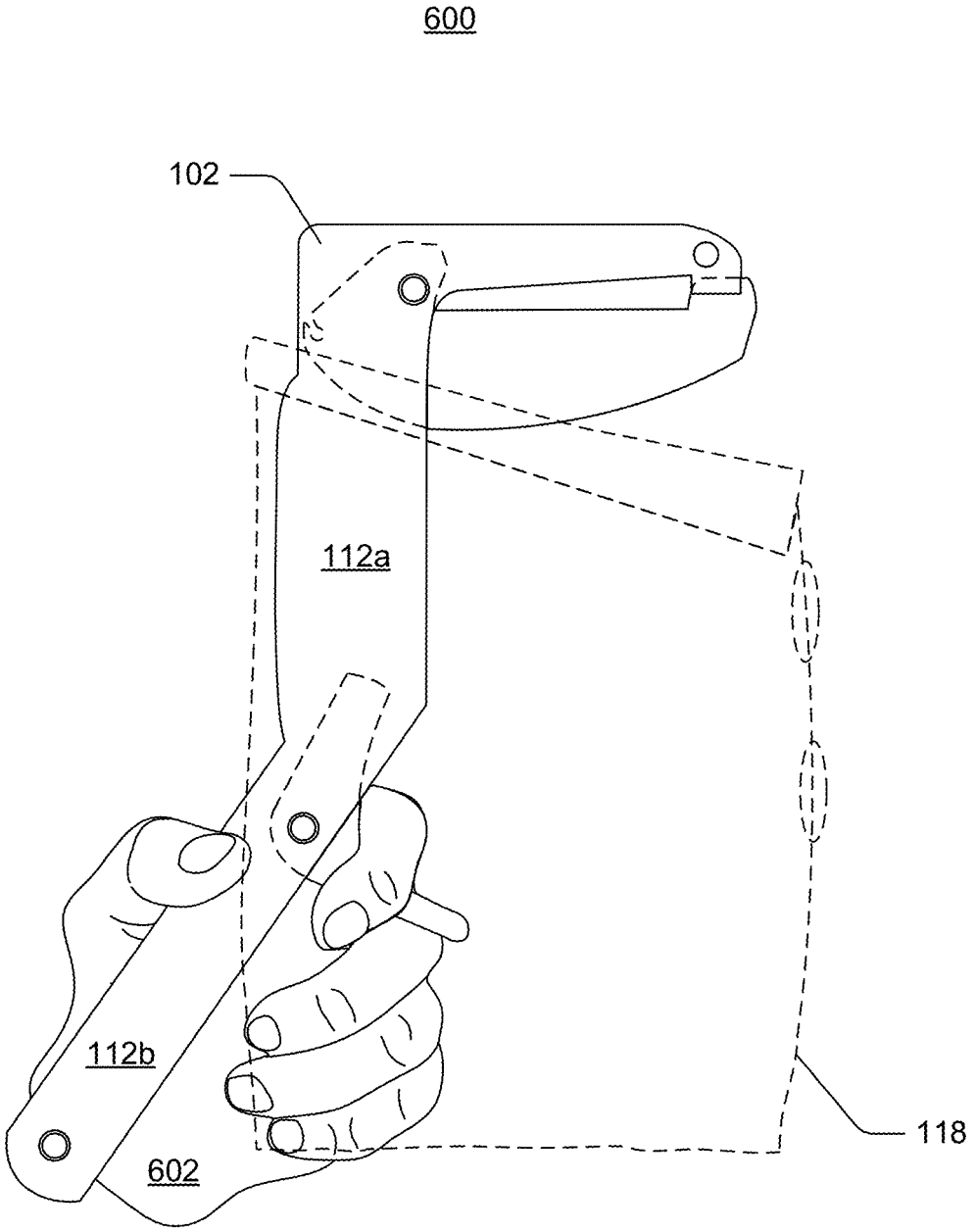
FIG. 6 depicts the removable device being manipulated by a hand of a user.

FIG. 6 depicts an example implementation 600 of the removable device being manipulated by a hand of a user. FIG. 6 includes a hand 602 of a user, and an outline of the body 118 of the hand puppet 104.

In one or more implementations, the control 110 is configured to be manipulated by the user's hand 602 at least partially outside the body 118. For instance, when the removable device 102 is inserted into the removable device 102, the superior portion of the handle 112*a* may be configured to extend along a posterior portion of the body 118. In addition or alternatively, the inferior portion of the handle 112*b* may be configured to extend at least partially in a posterior direction with respect to the body 118. In this way, the inferior portion of the handle 112*b* may form an obtuse angle with respect to the superior portion of the handle 112*a*. To this end, the handle 112 may extend outside the body 118 of the hand puppet 104 to facilitate user manipulation of the control 110 while the user's hand 602 is positioned at least partially in a posterior position in relation to the body 118, as shown Additionally, the control 110 is configured to be manipulated by the user's hand 602 at an inferior position in relation to the hand puppet 104's mouth. For instance, the handle 112 is configured to separate the control 110 from the first and second appendages 106, 108 substantially by length. This enables the user's hand 602 to manipulate the control 110 to control movement of the mouth of the hand puppet 104 at an inferior position in relation to, and a distance from, the mouth of the hand puppet 104. The depicted position of the user's hand 602 in relation to the body 118 (e.g., toward an inferior and posterior portion of the body 118) enables the user to comfortably operate the hand puppet 104 on the user's knee, lap, or a nearby chair—a position that is generally suitable for ventriloquism.

In one or more implementations, the control 110 may be disposed inferior to the depicted position. In other words, the control 110 may, alternatively, be disposed lower on the inferior portion of the handle 112*b*. In this way, the user may control mouth movement of the hand puppet 104 while the user's hand 602 is separated even further from the mouth of the hand puppet 104, and completely outside the body 118. It is also to be noted that the control 110 may be disposed at different distances from the first and second appendages 106, 108 for removable devices configured for different sizes of hand puppets. For instance, the distance between the control 110 and the first and second appendages 106, 108 may be greater for removable devices configured for larger hand puppets (e.g., 30-inch hand puppets) than removable devices configured for smaller hand puppets (e.g., 25-inch hand puppets). In addition or alternatively, the removable device may be sized according to different sizes of hand puppets. By way of example, a smaller version of the removable device 102 may be configured to be inserted into smaller hand puppets (e.g., 25-inch hand puppets), and a larger version of the removable device 102 may be configured to be inserted into larger hand puppets (e.g., 30-inch hand puppets). Indeed, the removable device 102 may be configured in various ways so that the length between the control 110 and the first and second appendages 106, 108 may vary without departing from the spirit or scope of the described techniques.

In one or more implementations, the control 110 may be configured as a trigger, as shown, and the trigger may be configured to be compressed with an amount of force which is easily applicable via an index finger of a human. In this way, the control 110 may be configured to be manipulated by a single finger of the user's hand 602. Thus, movement of the hand puppet 104's mouth may be controlled using only a single finger of the user's hand 602 while holding the handle 112 substantially in a palm and fingers of the hand 602. This provides an advantage over operation of a conventional hand puppet because, the user's entire arm need not be inserted into the hand puppet 104 to control movement of the mouth with the user's fingers and thumb inserted into the superior and inferior cavities 114, 116, respectively. The removable device 102 may thus enable generally ergonomic operation of the mouth of the hand puppet 104 using a single finger.

Figure 7:
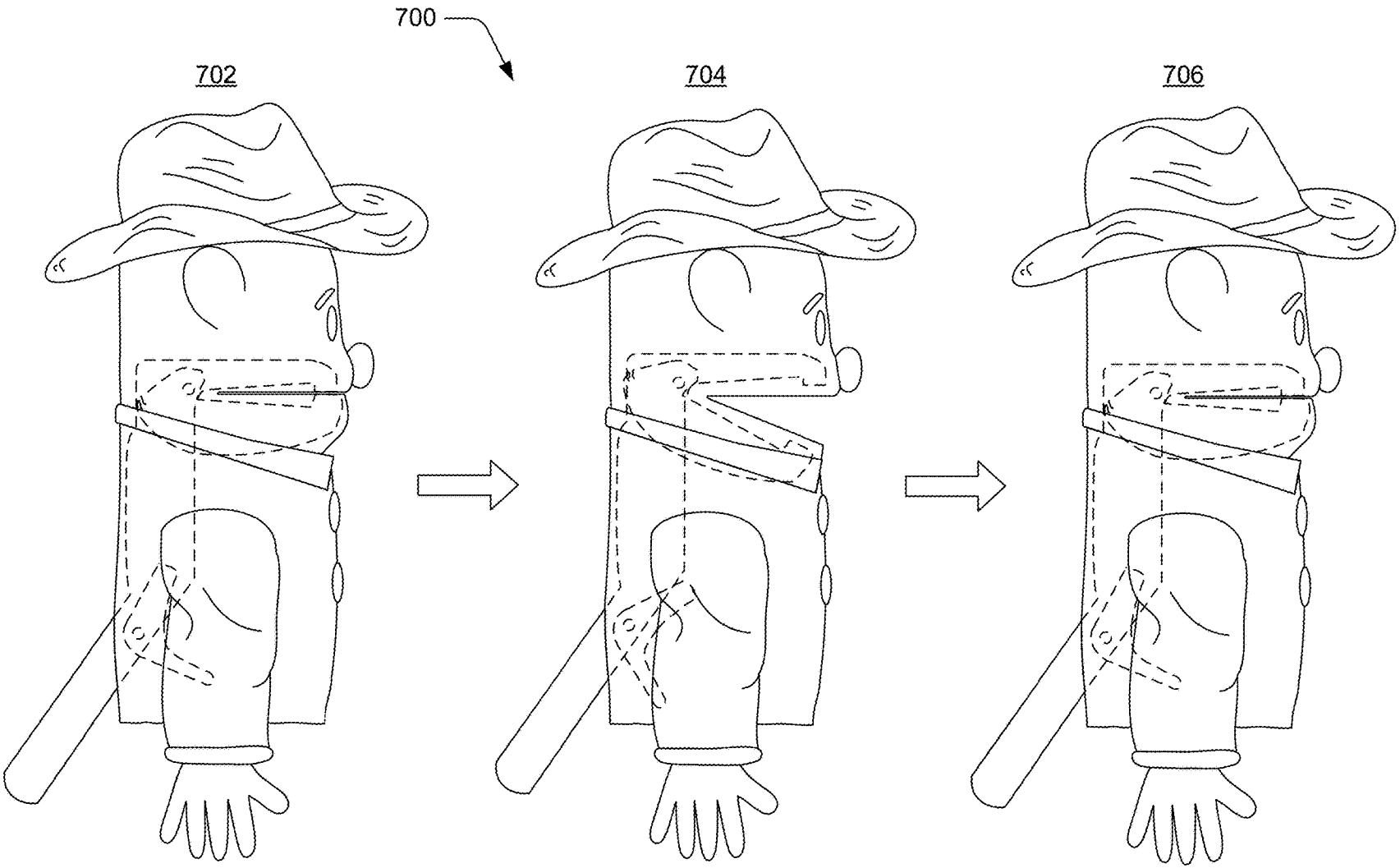
FIG. 7 depicts an example implementation in which mouth movement of the hand puppet is manipulated by the removable device.

FIG. 7 depicts an example 700 in which mouth movement of the hand puppet is manipulated by the removable device. FIG. 7 includes movement progressions 702, 704, 706 of the mouth of the hand puppet 104 as manipulated by the removable device 102.

At 702, no force is applied to the control 110 and the mouth of the hand puppet 104 is biased in a closed mouth expression, as previously discussed.

At 704, the force 202 is applied to the control 110 by the hand 602 of the user to create an open mouth expression of the hand puppet 104. For example, the force 202 is applied to the control 110 by the hand 602 of the user to cause the second appendage 108 to rotate from the closed position to the open position. As discussed above, the rotation of the second appendage 108 toward the open position is configured to cause the jaw of the hand puppet 104 to open in relation to the roof of the hand puppet 104's mouth. Further, the first appendage 106 is configured to remain substantially stationary as the second appendage 108 opens and closes. In this way, the first appendage 106 may maintain the roof of the hand puppet 104's mouth (and a top of the hand puppet 104's head) in a substantially stationary position, as the second appendage 108 causes the jaw of the hand puppet 104 to open.

At 706, the application of force 202 is released from the control 110 by the hand 602 of the user, causing the mouth of the hand puppet 104 to return to the closed mouth expression. For example, the application of force 202 may be released from the control 110 via the hand 602 of the user to cause the second appendage 108 to rotate from the open position to the closed position. As previously discussed, the rotation of the second appendage 108 toward the closed position is configured to cause the jaw of the hand puppet 104 to close in relation to the roof of the hand puppet 104's mouth. Further, the first appendage 106 is configured to remain substantially stationary as the second appendage 108 opens and closes. In this way, the first appendage 106 may maintain the roof of the hand puppet 104's mouth (and the top of the hand puppet 104's head) in a substantially stationary position, as the second appendage 108 causes the jaw of the hand puppet 104 to close.

Notably, the removable device 102 is configured to cause the jaw of the hand puppet 104 to open and close in relation to the roof of the hand puppet 104's mouth, while the roof of the hand puppet 104's mouth remains substantially stationary. This creates a more realistic mouth movement of the hand puppet 104 than conventional techniques because the hand puppet 104's jaw moves downward and upward in a manner that emulates mouth movement of a person or other creature. Alternatively, conventional operation generally causes the top of the hand puppet 104's head to swing back and the jaw to remain substantially stationary. In this context, consider the following discussion of FIG. 8.

Figure 8:
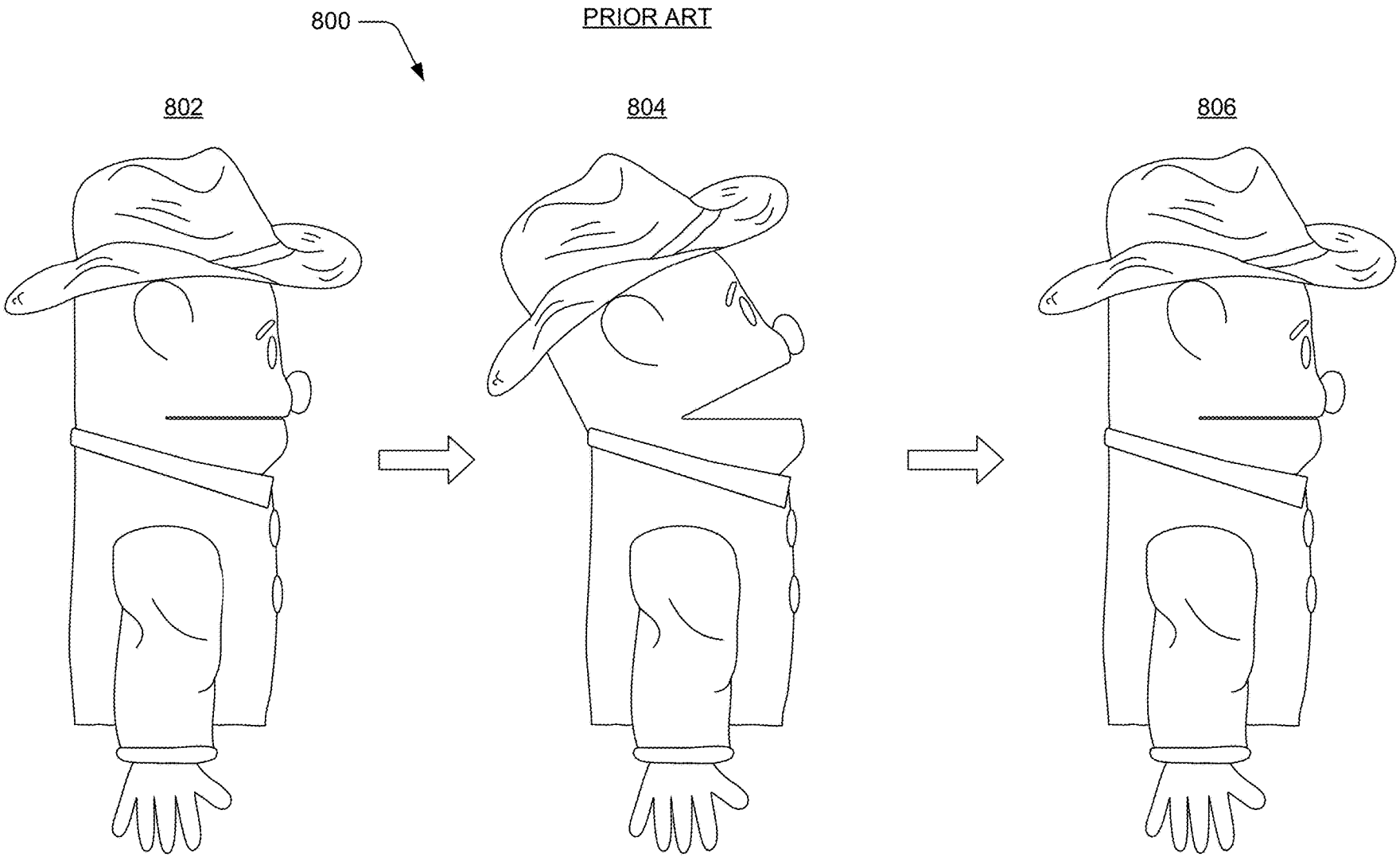
FIG. 8 depicts an example implementation in which mouth movement of the hand puppet is manipulated by a hand of a user according to conventional operation of a hand puppet.

FIG. 8 depicts an example 800 in which mouth movement of the hand puppet is manipulated by a hand of a user according to conventional operation of a hand puppet. FIG. 8 includes movement progressions 802, 804, 806 of the mouth of the hand puppet 104 as manipulated by a user's hand.

At 802, the hand puppet 104 is manipulated according to standalone operation of the hand puppet 104 by a hand of a user to create a closed mouth expression of the hand puppet 104. For example, the user's fingers may be inserted into the superior cavity 114, and the user's thumb may be inserted into the inferior cavity 116. The user may apply force to his or her thumb with the fingers to cause the roof of the hand puppet 104's mouth to close in relation to the jaw of the hand puppet 104.

At 804, the hand puppet 104 is manipulated according to standalone operation of the hand puppet 104 by the hand of the user to create an open mouth expression of the hand puppet 104. For example, the user may move his or her fingers away from the thumb to cause the roof of the hand puppet 104's mouth to open in relation to the jaw of the hand puppet 104.

At 806, the hand puppet 104 is manipulated according to standalone operation of the hand puppet 104 by the hand of the user to return the mouth of the hand puppet 104 to the closed mouth expression. For example, the user may move his or her fingers back toward the thumb to cause the roof of the hand puppet 104's mouth to close in relation to the jaw of the hand puppet 104.

Unlike the mouth movement of the hand puppet 104 as manipulated by the removable device 102 illustrated in FIG. 7, standalone operation of the hand puppet 104 causes the roof of the hand puppet 104's mouth and the top of the hand puppet 104's head to open and close in relation to the jaw of the hand puppet 104. In contrast to the movement illustrated in FIG. 7, use of a user's hand 602 to open the hand puppet 104's mouth causes the top of the hand puppet 104's head to swing backward rather than the jaw to lower. This is because movement of a person's hand to open and close the fingers in relation to the thumb naturally results in the majority of movement coming from the fingers. In other words, it is not natural for a person to move their thumb away from, and back toward their fingers over and over again while keeping his or her fingers stationary. As such, conventional operation of a hand puppet often results in the jaw of the hand puppet 104 remaining substantially stationary, while the roof of the hand puppet 104's mouth opens and closes. This results in a far less realistic mouth movement of the hand puppet 104 as it contradicts mouth movement of a person or other creature and causes the entire top portion of the hand puppet 104's head to open in relation to the jaw, as illustrated. Accordingly, conventional operation of a hand puppet is less desirable when performing ventriloquism since expressions that are more lifelike are generally preferred for ventriloquism.

Figure 9:
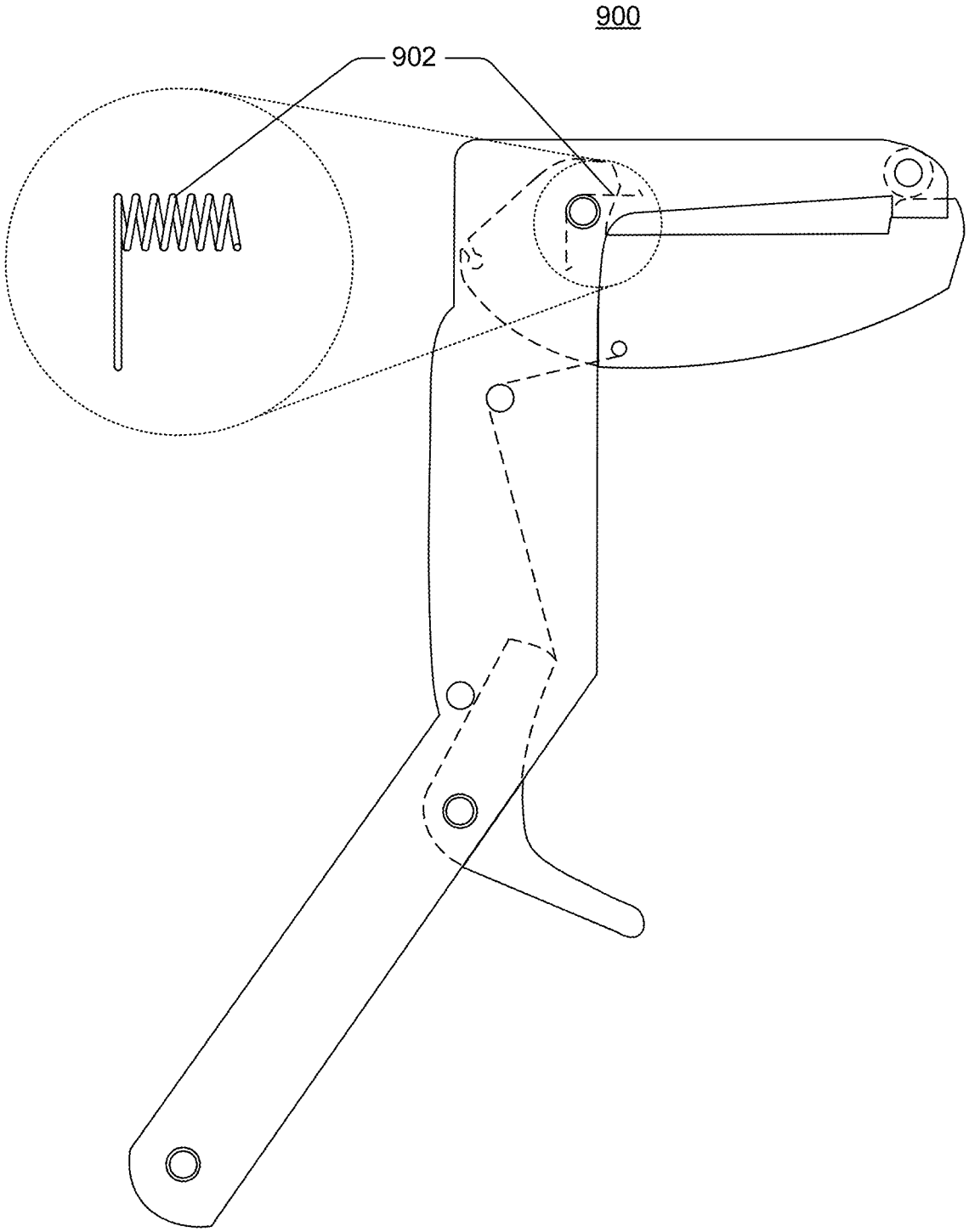
FIG. 9 depicts an example implementation in which the removable device includes a spring to bias the removable device in a default position rather than an elastic tensioner.

FIG. 9 depicts an example implementation in which the removable device includes a spring to bias the removable device in a default position rather than using an elastic tensioner.

In the illustrated example 900, the removable device 102 is depicted with spring 902. An example of which is a torsion spring. In contrast to the examples depicted in FIGS. 3, 4, and 5, the torsion spring 902 is configured to bias the removable device 102 in a default (e.g., closed mouth) position, rather than using an elastic tensioner. In implementations where the torsion spring 902 is used, the torsion spring 902 is configured to have similar functionality to the elastic tensioner. In one or more implementations, the torsion spring 902 may include a first leg that is configured to be attached or fastened to the first appendage 106, and a second leg that is configured to be attached or fastened to the second appendage 108. Given this, as the second appendage 108 rotates clockwise the torsion spring 902 is twisted to cause the torsion spring 902 to be loaded. The loaded torsion spring 902 applies torque to the second appendage 108 in the counterclockwise direction via the attachment of the second leg to the second appendage 108. Therefore, as the application of force 202 is released from the control 110, the torsion spring 902 may bias the second appendage 108 toward the default position.

Accordingly, it is to be appreciated that the appendages 106, 108 of the removable device 102 may be biased into default positions in a variety of ways without departing from the spirit or scope of the described techniques.

Figure 10:
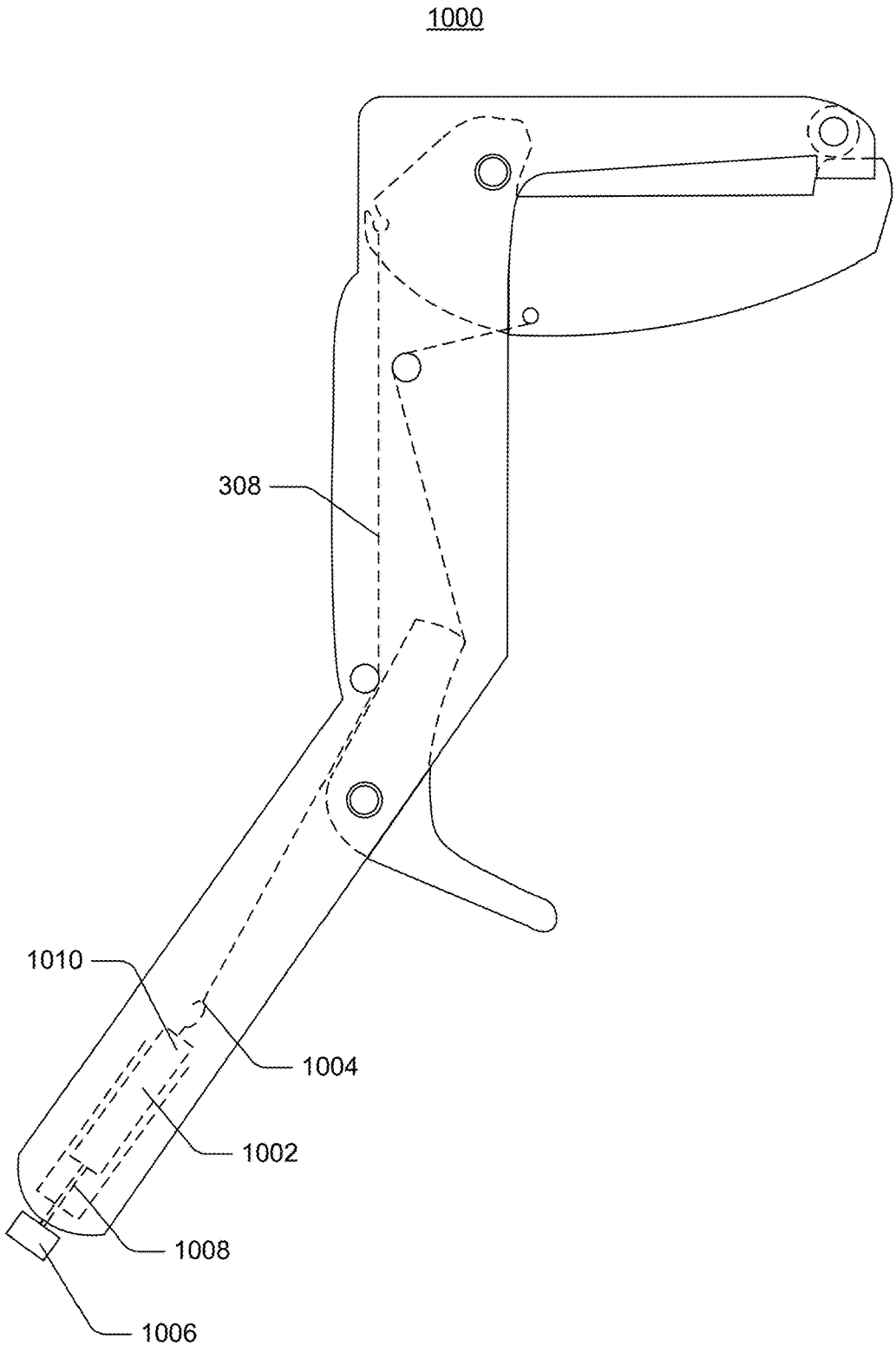
FIG. 10 depicts an example implementation in which the removable device includes a tension adjustment element to increase or decrease an amount of force required to manipulate a control of the removable device.

FIG. 10 depicts an example implementation in which the removable device includes a tension adjustment element to increase or decrease an amount of force required to manipulate a control of the removable device.

In the illustrated example 1000, the removable device 102 is depicted with tension adjustment element 1002. The tension adjustment element 1002 is configured to increase or decrease an amount of tension in the tensioner 308. As the amount of tension in the tensioner 308 decreases, the amount of force required to manipulate the control 110 also decreases. Similarly, as the amount of tension in the tensioner 308 increases, the amount of force required to manipulate the control 110 also increases. Given this, a user may fine-tune the tension in the tensioner 308 according to the user's preferences in order to manipulate the control 110 with as little or as much force as is comfortable to the user. For example, a user may adjust the tension in the tensioner 308 such that the control 110 may be depressed with relatively little force, while still maintaining enough tension in the tensioner 308 to bias the second appendage 108 in the default position.

In the depicted example, the tension adjustment element 1002 is attached to the tensioner 308 at an attachment point 1004 and includes, an adjustment knob 1006, a shaft 1008, and an anchor 1010. The anchor 1010 is configured to have similar functionality to the anchor 310, as depicted in FIGS. 3, 4, and 5. In this example implementation, rotation of the adjustment knob 1006 is configured to cause the anchor 1010 to move along the shaft 1008. For example, a user may rotate the adjustment knob 1006 clockwise to cause the anchor 1010 to move along the shaft 1008 toward the adjustment knob 1006. In this way, the attachment point 1004 may also move toward the adjustment knob 1006 to increase the tension in the tensioner 308 by elongating the tensioner 308. In addition or alternatively, a user may rotate the adjustment knob 1006 counterclockwise to cause the anchor 1010 to move along the shaft 1008 away from the adjustment knob 1006. In this way, the attachment point 1004 may also move away from the adjustment knob 1006 to decrease the tension in the tensioner 308 by shortening the tensioner 308. Since adjustment of the tension in the tensioner 308 also adjusts the amount of force required to depress the control 110, a user may manipulate the adjustment knob to adjust the amount of force required to depress the control 110.

Although the tension adjustment element 1002 may be configured to adjust tension in an elastic tensioner 308, as depicted and discussed above, it is to be appreciated that the tension adjustment element 1002 may be configured in other ways without departing from the spirit or scope of the described techniques. By way of example, the tension adjustment element 1002 may be configured to adjust tension in a spring such as torsion spring 902.

Having discussed example details of the techniques involving a removable device for control of a hand puppet, consider now some example procedures to illustrate additional aspects of the techniques.

Example Procedures

This section describes example procedures of a removable device for control of a hand puppet in one or more implementations. The procedures are shown as a set of blocks and are not necessarily limited to the orders shown for performing the operations by the respective blocks.

Figure 11:
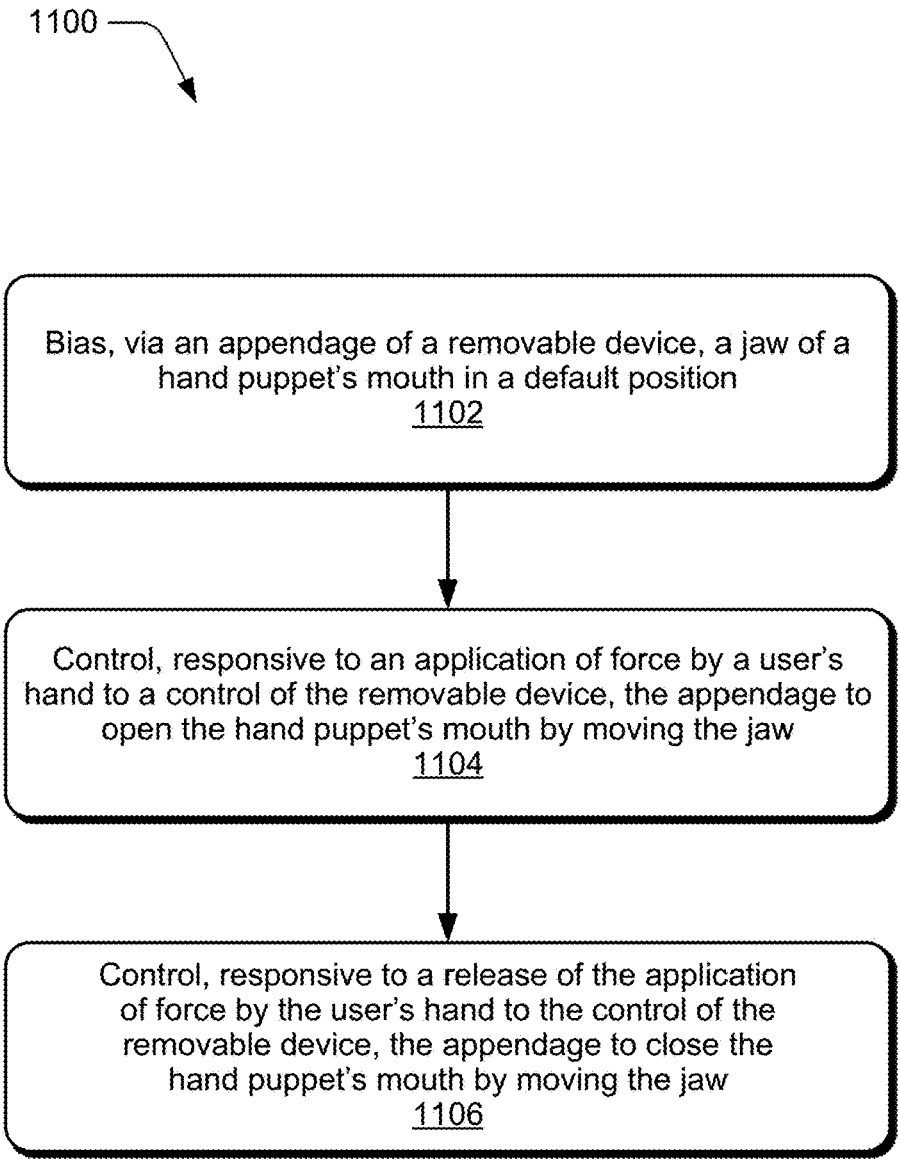
FIG. 11 depicts a procedure in an example implementation in which a removable device is manipulated to cause a jaw of a hand puppet to open and close.

FIG. 11 depicts an example procedure 1100 in which a removable device is manipulated to cause a jaw of the hand puppet to open and close.

A jaw of a hand puppet is biased, via an appendage of a removable device, in a default position (block 1102). By way of example, the second appendage 108 of the removable device 102 biases the jaw of the hand puppet 104 in a default position. In one or more implementations, the default position corresponds to a closed mouth position of the hand puppet 104. Thus, the second appendage 108 biases the jaw of the hand puppet 104 in a closed position in relation to the roof of the hand puppet 104's mouth. For instance, the tensioner 308 creates torque in the second appendage 108, even when there is no force applied to the control 110. The torque in the second appendage 108 causes an application of force to be applied to a superior inner surface of the hand puppet 104's inferior cavity 116. This application of force causes the jaw of the hand puppet 104 to rest in a closed position in relation to the roof of the hand puppet 104's mouth.

The appendage is controlled, responsive to an application of force by a user's hand to a control of the removable device, to open the hand puppet's mouth by moving the jaw (block 1104). By way of example, a user may apply the force 202 to the control 110 of the removable device 102, via his or her hand 602, which causes the second appendage 108 to rotate from a closed position, as shown in FIG. 3, to an open position, as shown in FIG. 4. The rotation of the second appendage 108 causes an application of force to be applied to an inferior inner surface of the hand puppet 104's inferior cavity 116. This application of force causes the jaw of the hand puppet 104 to open in relation to the roof of the hand puppet 104's mouth to create an open mouth expression of the hand puppet 104. In one or more implementations, controlling the second appendage 108 to open the jaw of the hand puppet 104 does not substantially alter a position of the superior cavity 114. The second appendage 108 thus causes the mouth of the hand puppet 104 to open by opening the hand puppet 104's jaw in relation to the roof of the hand puppet 104's mouth, while the roof of the hand puppet 104's mouth remains substantially stationary.

The appendage is controlled, responsive to a release of the application of force by the user's hand to the control of the removable device, to close the hand puppet's mouth by moving the jaw (block 1106). By way of example, a user may release the application of force 202 from the control 110 via his or her hand 602, which causes the second appendage 108 to rotate from the open position, as shown in FIG. 4, to the closed position, as shown in FIG. 3. The rotation of the second appendage 108 causes an application of force to be applied to a superior inner surface of the hand puppet 104's inferior cavity 116. This application of force causes the jaw of the hand puppet 104 to close in relation to the roof of the hand puppet 104's mouth to create a closed mouth expression of the hand puppet 104. For example, the second appendage 108 causes the jaw of the hand puppet 104 to close until the jaw makes contact with the roof of the hand puppet 104's mouth—preventing the jaw from rotating any further. In this way, the jaw of the hand puppet 104 returns to the default closed mouth position. The second appendage 108 thus causes the mouth of the hand puppet 104 to close by closing the hand puppet 104's jaw in relation to the roof of the hand puppet 104's mouth.

Figure 12:
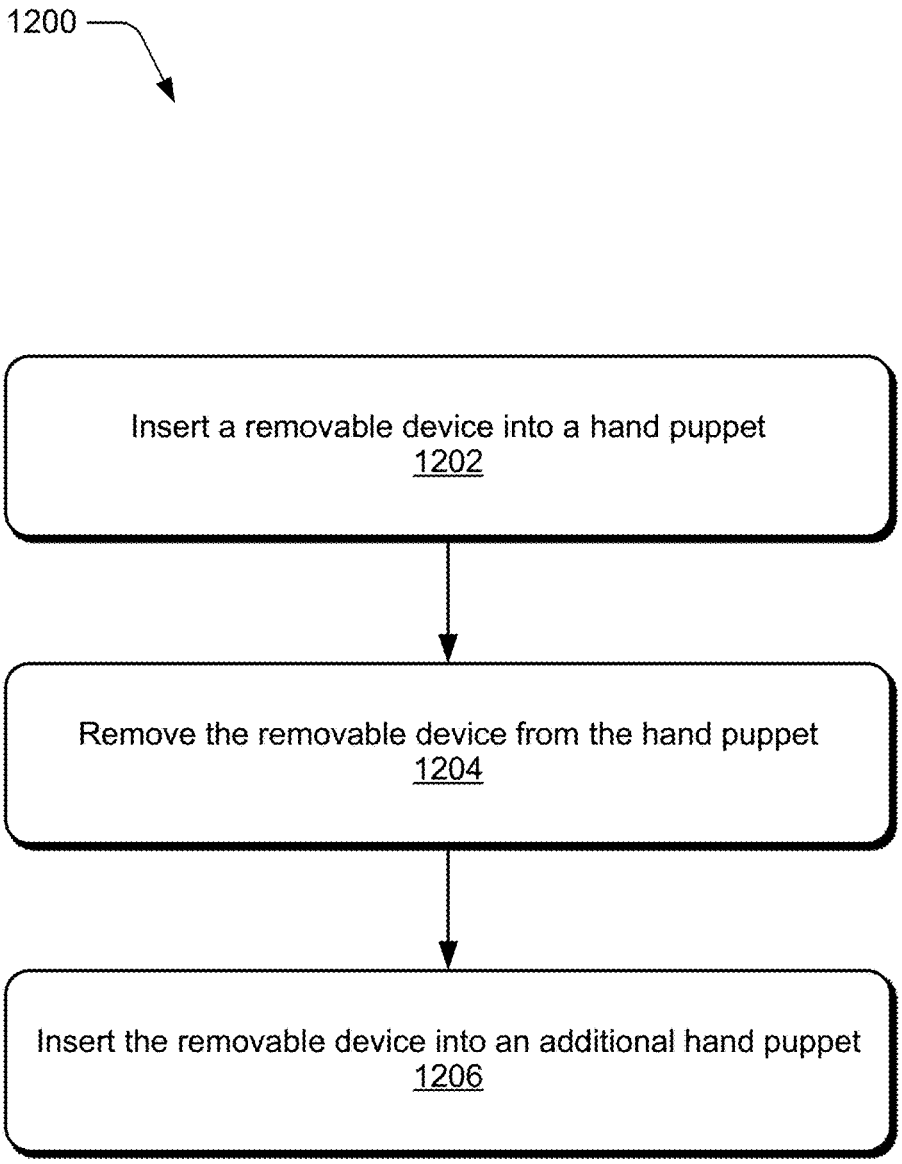
FIG. 12 depicts a procedure in an example implementation in which a removable device is removed from a hand puppet and inserted into an additional hand puppet.

FIG. 12 depicts an example procedure 1200 in which a removable device is removed from a hand puppet and inserted into an additional hand puppet.

A removable device is inserted into a hand puppet (block 1202). By way of example, the removable device 102 is inserted into the hand puppet 104. The removable device 102 is configured not to damage or alter the hand puppet 104 when inserted into it. After the removable device 102 is inserted into the hand puppet 104, the hand puppet 104 is capable of being operated according to techniques described herein, such as according to example procedure 900.

The removable device is removed from the hand puppet (block 1204). By way of example, the removable device 102 is removed from the hand puppet 104. The removable device 102 is configured not to damage or alter the hand puppet 104 when removed from it. In this way, after the removable device 102 is removed from the hand puppet 104, the hand puppet 104 is capable of being operated by hand according to conventional operation of a hand puppet, as illustrated in FIG. 8. In other words, the removable device 102 is configured not to alter conventional, standalone operation of the hand puppet 104 when the removable device 102 is inserted and removed from the hand puppet 104.

The removable device is inserted into an additional hand puppet (block 1206). By way of example, the removable device 102 is inserted into an additional hand puppet. The removable device 102 is further configured not to damage or alter the additional hand puppet when inserted into and removed from the additional hand puppet. In this way, the removable device 102 is capable of operating a plurality of hand puppets. Further, each of the plurality of hand puppets operated by the removable device 102, may still be operated by hand according to conventional operation of a hand puppet when the removable device 102 is removed.

What is claimed is:

1. A removable device for control of a hand puppet, the removable device comprising:

a first appendage for insertion into a superior cavity of a head of the hand puppet;

a second appendage for insertion into an inferior cavity of the head of the hand puppet, the inferior cavity corresponding to a jaw of a mouth of the hand puppet;

a control configured to control the second appendage to open and close the mouth by moving the jaw; and a flexible tensioner attached to an attachment point of the second appendage and to a superior portion of the control, the flexible tensioner further wrapped around a spacer disposed between the attachment point of the second appendage and the superior portion of the control, and the flexible tensioner configured, responsive to a force applied to an inferior portion of the control which creates tension in the flexible tensioner, to apply an additional force to the second appendage via the attachment point to control the second appendage to open the mouth.

2. The removable device of claim 1, wherein the first appendage is configured to remain stationary as the second appendage opens and closes.

3. The removable device of claim 1, wherein the control is configured to cause the second appendage to rotate from a closed position to an open position responsive to application of force by a hand of a user to manipulate the control.

4. The removable device of claim 3, wherein the control is configured to cause the second appendage to rotate from the open position to the closed position responsive to release of the force by the hand of the user.

5. The removable device of claim 3, wherein rotation of the second appendage from the closed position to the open position causes the jaw of the hand puppet to open to create an open mouth expression of the hand puppet.

6. The removable device of claim 1, wherein the removable device is configured to be removed from the hand puppet and inserted into an additional hand puppet.

7. The removable device of claim 1, wherein the removable device is configured to be inserted into the hand puppet and removed from the hand puppet without altering standalone operation of the hand puppet by a user's hand when the removable device is removed.

8. The removable device of claim 1, wherein:

the control is disposed on a handle and the first appendage and the second appendage extend from the handle; and a length of the handle between the control and the first appendage and the second appendage is configured to separate a hand of a user manipulating the control from the mouth by the length.

9. The removable device of claim 8, wherein the handle is configured to extend outside a body of the hand puppet to facilitate user manipulation of the removable device at least partially outside the body of the hand puppet.

10. A system comprising:

a hand puppet, and a removable device inserted into the hand puppet, the removable device configured to:

bias, via an appendage of the removable device, a jaw of a mouth of the hand puppet in a default position; and control, responsive to manipulation by a user's hand of a control of the removable device, the appendage of the removable device to open and close the mouth by moving the jaw, wherein a flexible tensioner attached to a superior portion of the control and an attachment point of the appendage is wrapped around a spacer disposed between the attachment point of the appendage and the superior portion of the control, the flexible tensioner biasing the jaw and enabling control of the appendage.

11. The system of claim 10, wherein control of the appendage moves the jaw without altering a roof of the mouth.

12. The system of claim 10, wherein the removable device is further configured to be removed from the hand puppet and inserted into an additional hand puppet.

13. The system of claim 12, wherein the removable device is further configured to be inserted into the hand puppet and removed from the hand puppet without altering standalone operation of the hand puppet by the user's hand when the removable device is removed.

* * * * *